US009747916B2

(12) United States Patent
Ehara et al.

(10) Patent No.: US 9,747,916 B2
(45) Date of Patent: Aug. 29, 2017

(54) CELP-TYPE SPEECH CODING APPARATUS AND METHOD USING ADAPTIVE AND FIXED CODEBOOKS

(71) Applicant: Panasonic Intellectual Property Corporation of America, Torrance, CA (US)

(72) Inventors: Hiroyuki Ehara, Kanagawa (JP); Takako Hori, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 15/002,328

(22) Filed: Jan. 20, 2016

(65) Prior Publication Data

US 2016/0140976 A1 May 19, 2016

Related U.S. Application Data

(63) Continuation of application No. PCT/JP2014/003581, filed on Jul. 7, 2014.

(30) Foreign Application Priority Data

Aug. 22, 2013 (JP) ..... 2013-172310

(51) Int. Cl.
*G10L 19/00* (2013.01)
*G10L 19/12* (2013.01)
(Continued)

(52) U.S. Cl.
CPC ..... *G10L 19/12* (2013.01); *G10L 19/005* (2013.01); *G10L 19/038* (2013.01);
(Continued)

(58) Field of Classification Search
CPC ..... G10L 19/12; G10L 19/038; G10L 19/005
(Continued)

(56) References Cited

U.S. PATENT DOCUMENTS 5,677,986 A * 10/1997 Amada ..... H03M 7/3082 348/422.1
5,970,444 A 10/1999 Hayashi et al.
(Continued)

FOREIGN PATENT DOCUMENTS

JP 10-312198 11/1998
JP 11-126096 5/1999
(Continued)

OTHER PUBLICATIONS

International Search Report of PCT application No. PCT/JP2014/003581 dated Aug. 26, 2014.

*Primary Examiner* — Shaun Roberts
(74) *Attorney, Agent, or Firm* — Greenblum & Bernstein, P.L.C.

(57) ABSTRACT

In a CELP-type speech coding apparatus, switching between an orthogonal search of a fixed codebook and a non-orthogonal search is performed in a practical and effective manner. The CELP-type speech coding apparatus includes a parameter quantizer that selects an adaptive codebook vector and a fixed codebook vector so as to minimize an error between a synthesized speech signal and an input speech signal. The parameter quantizer includes a fixed codebook searcher that switches between the orthogonal fixed codebook search and the non-orthogonal fixed codebook search based on a correlation value between a target vector for the fixed codebook search and the adaptive codebook vector obtained as a result of a synthesis filtering process.

5 Claims, 9 Drawing Sheets

(51) Int. Cl.
*G10L 19/005* (2013.01)
*G10L 19/038* (2013.01)
*G10L 19/125* (2013.01)

(52) U.S. Cl.
CPC ..... *G10L 19/125* (2013.01); *G10L 2019/001* (2013.01); *G10L 2019/0002* (2013.01); *G10L 2019/0013* (2013.01); *G10L 2019/0016* (2013.01)

(58) Field of Classification Search
USPC ..... 704/219
See application file for complete search history.

(56) References Cited

U.S. PATENT DOCUMENTS

| | | | | |
|---|---|---|---|---|
| 6,507,814 | B1 * | 1/2003 | Gao | G10L 19/005 704/219 |
| 9,076,443 | B2 * | 7/2015 | Malenovsky | G10L 19/083 |
| 2006/0106600 | A1 * | 5/2006 | Bessette | G10L 19/12 704/223 |
| 2009/0024399 | A1 * | 1/2009 | Gartner | G10L 21/038 704/500 |
| 2009/0177464 | A1 * | 7/2009 | Gao | G10L 19/083 704/207 |

FOREIGN PATENT DOCUMENTS

| | | |
|---|---|---|
| JP | 2006-505828 | 2/2006 |
| WO | 2004/044890 | 5/2004 |

* cited by examiner

CELP-TYPE SPEECH CODING APPARATUS AND METHOD USING ADAPTIVE AND FIXED CODEBOOKS

BACKGROUND

1. Technical Field

The present disclosure relates to a compression coding apparatus that effectively codes speech information into a compressed form and a method therefor, and more particularly, to a speech coding apparatus of a code excited linear prediction (CELP) type and a method therefor.

2. Description of the Related Art

FIG. 7 is a block diagram illustrating a CELP-type speech coding apparatus. In the CELP-type speech coding apparatus 100, an excitation signal E which is a driving vector is generated such that an adaptive codebook vector p representing a periodic component output from an adaptive codebook 101 is multiplied by an adaptive codebook gain $g_p$ using an amplifier 102, and a resultant vector is added, by an adder 105, with a vector obtained by multiplying a fixed codebook vector c representing a non-periodic component output from a fixed codebook 103 by a fixed codebook gain $g_c$ using an amplifier 104. The generated excitation signal E drives a synthesis filter 106, which operates based on a linear prediction coefficient obtained by performing linear prediction analysis on an input speech signal and further quantization, thereby generating a synthesized speech signal in the form of a speech signal vector.

In the CELP-type speech coding apparatus 100, an error calculator 107 calculates an error of the generated synthesized speech signal with respect to the input speech signal, and a parameter quantization unit 108 determines an adaptive codebook vector, an adaptive codebook gain, a fixed codebook vector, and a fixed codebook gain so as to minimize the error described above (analysis by synthesis). To minimize perceptual distortion, perceptual weighting is performed by a perceptual weighting filter 109, and thereafter minimization of the error of the generated synthesized speech signal with respect to the input speech signal is performed.

In general, the minimization of the error by the parameter quantization unit 108 is performed in a sequential manner such that first an adaptive codebook vector is determined by an adaptive codebook search unit 110, and then a fixed codebook vector is determined by a fixed codebook search unit 111. Furthermore, an adaptive codebook gain and a fixed codebook gain are determined by a gain codebook search unit 112. In general, the process of determining the adaptive codebook vector is referred to as an adaptive codebook search, and the process of determining the fixed codebook vector is referred to as a fixed codebook search. In this case, the adaptive codebook vector is first determined without taking into account the combination with the fixed codebook vector, and thus the obtained combination of the adaptive codebook vector and the fixed codebook vector is not necessarily an optimum solution.

To perform the fixed codebook search, two methods are known: a non-orthogonal search; and an orthogonal search. In the non-orthogonal search, the fixed codebook search is performed while the adaptive codebook vector and the adaptive codebook gain are fixed. In the orthogonal search, the fixed codebook search is performed while only the adaptive codebook vector is fixed. Therefore, in the orthogonal search, an optimum combination of an adaptive codebook vector and a fixed codebook vector is determined without restricting the adaptive codebook gain and the fixed codebook gain. This generally allows it to obtain, in the fixed codebook search, a result closer to the optimum solution than can be obtained by the non-orthogonal search. However, a greater amount of calculation is required (see, for example, Japanese Unexamined Patent Application Publication No. 11-126096).

Note that in the orthogonal search of the fixed codebook, it is premised that the adaptive codebook gain and the fixed codebook gain are ideal (optimum values) for the selected adaptive codebook vector and fixed codebook vector. That is, the selection of the adaptive codebook vector and the fixed codebook vector is not necessarily performed such that the adaptive codebook vector and fixed codebook vector are selected so as to be optimum for the finally quantized adaptive codebook gain and fixed codebook gain. Therefore, in the actual CELP coding process, the orthogonal search does not necessarily give a better result than the non-orthogonal search.

In view of the above, in a certain known technique, the orthogonal search is used only when the ideal value (the optimum value) of the adaptive codebook gain is greater than a threshold value, and otherwise the non-orthogonal search is used (Japanese Unexamined Patent Application Publication No. 10-312198).

SUMMARY

One non-limiting and exemplary embodiment provides a speech coding apparatus and a method in which the effectiveness of the orthogonal search for the fixed codebook vector is evaluated more strictly, and accordingly the orthogonal search or the non-orthogonal search is properly selected in the fixed codebook search.

In one general aspect, the techniques disclosed here feature that a speech coding apparatus includes an adaptive codebook that outputs an adaptive codebook vector representing a periodic component, a fixed codebook that outputs a fixed codebook vector representing a non-periodic component, an adder that generates an excitation signal from the adaptive codebook vector and the fixed codebook vector, a synthesis filter that operates based on a linear prediction coefficient obtained by performing linear prediction analysis on an input speech signal and quantization and that is driven by the excitation signal thereby generating a synthesized speech signal, and a parameter quantization unit that selects the adaptive codebook vector and the fixed codebook vector so as to minimize an error between the synthesized speech signal and the input speech signal, wherein the parameter quantization unit includes a fixed codebook search unit that switches between an orthogonal fixed codebook search and a non-orthogonal fixed codebook search based on a correlation value between a target vector for the fixed codebook search and the adaptive codebook vector obtained as a result of the process by the synthesis filter.

The "periodic component" may be a component having some periodicity such as that typified by a pitch period.

The "adaptive codebook" may be a codebook in which past excitation signals have been accumulated or another codebook in which signals having periodic components have been accumulated.

The "non-periodic component" may be a while Gaussian noise or another component with low periodicity compared with the periodic component.

The "fixed codebook" may be a narrowly defined fixed codebook or a fixed codebook in which signals with a non-periodic component are stored, such as an algebraic codebook in which a non-periodic component is represented by a pulse.

The "excitation signal" may be an excitation signal generated at least from the adaptive codebook vector and the fixed codebook vector or, as a matter of course, an excitation signal generated using further another parameter such as the adaptive codebook gain, the fixed codebook gain, etc.

The "orthogonal fixed codebook search" is a search method in which a plurality of fixed codebook vectors that are candidates for an adaptive codebook vector determined in advance are orthogonalized to each other, and one fixed codebook vector that minimizes the distortion is selected from the plurality of orthogonalized fixed codebook vectors.

The "non-orthogonal fixed codebook search" is a search method other than the orthogonal fixed codebook search.

The "target vector for the fixed codebook search" is a target vector obtained by removing the adaptive codebook component from the target vector for the adaptive codebook search.

The "adaptive codebook vector obtained as a result of the process by the synthesis filter" is obtained by convolving the adaptive codebook vector with an impulse response of the synthesis filter. Note that in a case where a perceptual weighting filter is provided, its impulse response may also be convolved.

The "correlation value" represents similarity between two vectors, and may be expressed, for example, using a formula including at least an inner product of two signals.

The present disclosure makes it possible to achieve the speech coding apparatus capable of performing high-efficiency speech coding by properly switching the orthogonal search and the non-orthogonal search in the fixed codebook search.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
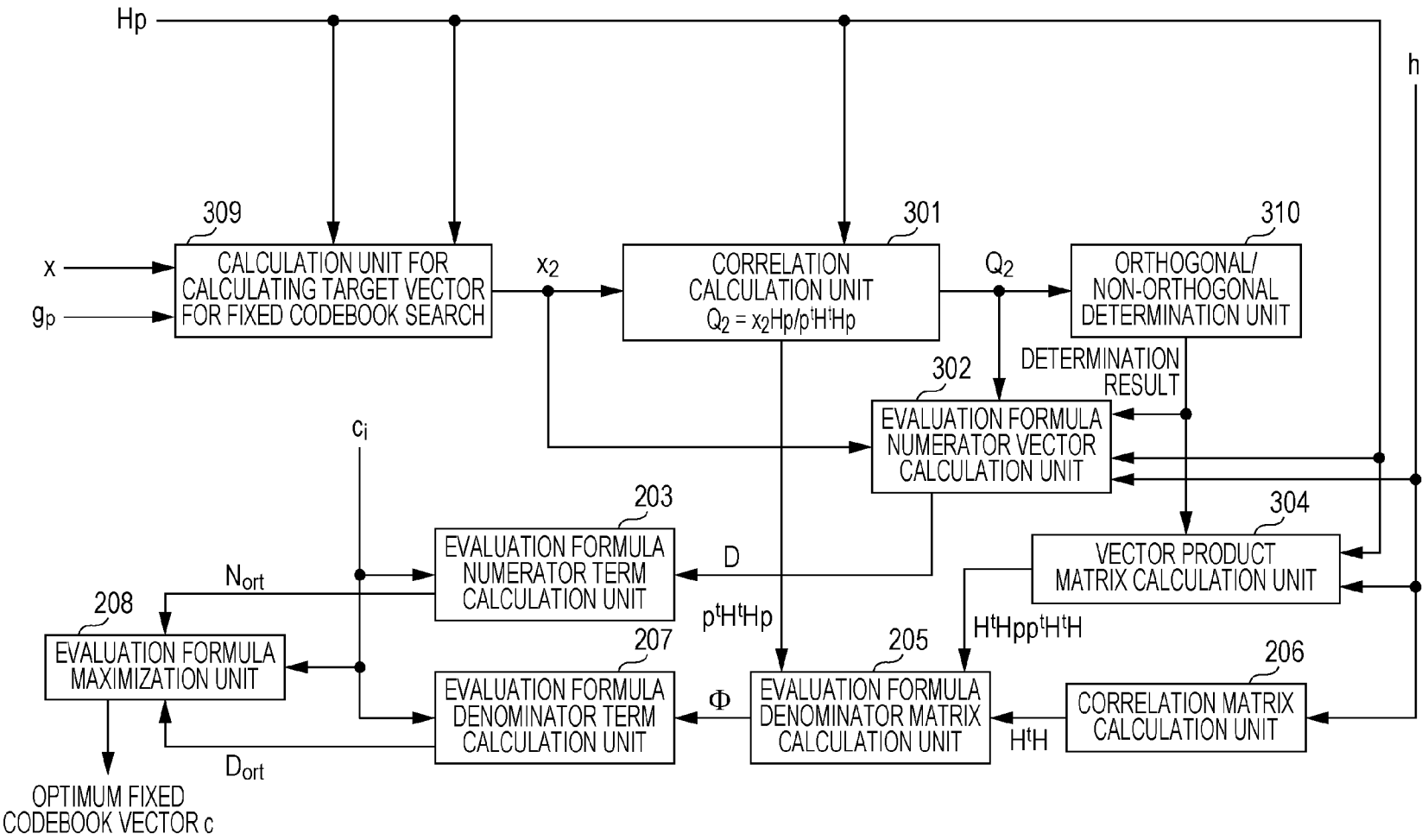
FIG. 1 is a block diagram illustrating a fixed codebook search unit according to a first embodiment of the present disclosure.

Underlying Knowledge Forming Basis of the Present Disclosure

In one of known techniques of an orthogonal search for fixed codebook using a conventional CELP-type speech coding apparatus, equation (1) is used as an evaluation formula $E_{ort}$ in terms of coding distortion in the search (see, for example, Math. 1 and Math. 7 in Japanese Unexamined Patent Application Publication No. 11-126096).

$$E_{ort} = \frac{N_{ort}}{D_{ort}} = \frac{|(p^t H^t Hpx - x^t HpHp)^t Hc|^2}{c^t((p^t H^t Hp)H^t H - H^t Hpp^t H^t H)c} \tag{1}$$

p: an adaptive codebook vector selected from an adaptive codebook

H: a matrix for convolution of an impulse response of the weighting synthesis filter x: a target vector for the adaptive codebook search (a signal obtained by subtracting a zero input response of the weighting synthesis filter from a weighted input speech signal)

c: a fixed codebook vector generated from a fixed codebook t: transposing of a matrix or a vector H is a matrix that produces convolution of the impulse response of the weighting synthesis filter. However, in the present embodiment, the perceptual weighting filter 109 is provided, and the impulse response of this filter is also convoluted, that is, the convolution is performed on the impulse response of a cascade connection of the synthesis filter 106 and the perceptual weighting filter 109.

$E_{ort}$ is an evaluation value indicating a relative value of coding distortion. In a case where an adaptive codebook vector p is already selected, $p^tH^tHp$ is constant, and thus $E_{ort}$ may be given by equation (2) obtained by removing $p^tH^tHp$ in the denominator term in equation (1).

$$E_{ort} = \frac{N_{ort}}{D_{ort}} = \frac{\left|\left(x - \frac{(x^t Hp)Hp}{p^t H^t Hp}\right)^t Hc\right|^2}{c^t\left(H^t H - \frac{H^t Hpp^t H^t H}{p^t H^t Hp}\right)c} \tag{2}$$

In equation (2), if the vector D and the matrix Φ are defined as described below, then equation (2) can be rewritten as equation (3). The vector D and the matrix Φ are components that can be easily calculated in advance in the orthogonal search of the fixed codebook.

$$D = \left(x - \frac{(x^t Hp)Hp}{p^t H^t Hp}\right)^t H \tag{3}$$

$$\Phi = H^t H - \frac{H^t Hpp^t H^t H}{p^t H^t Hp}$$

-continued $$E_{ort} = \frac{N_{ort}}{D_{ort}} = \frac{|Dc|^2}{c^t \Phi c}$$

Figure 8:
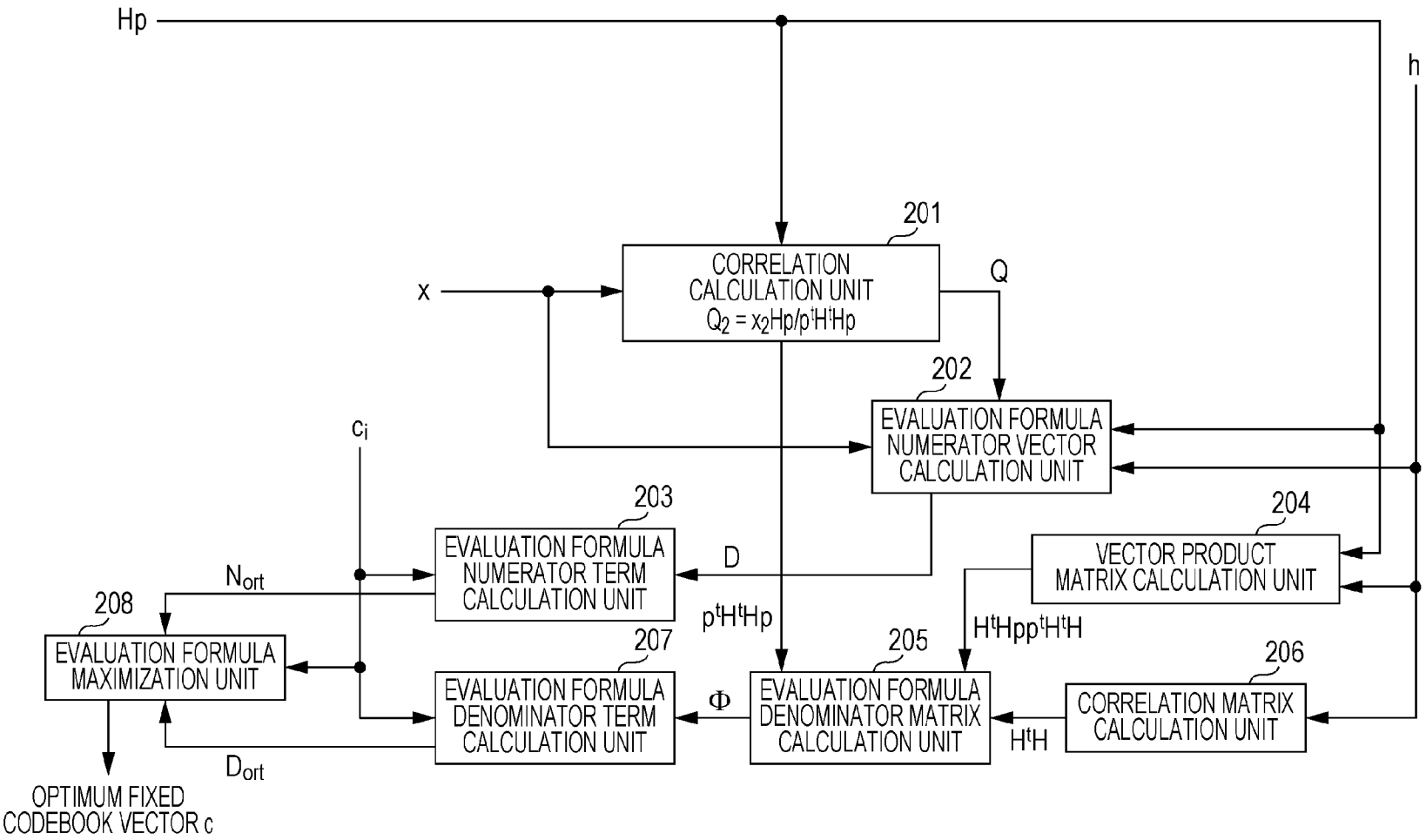
FIG. 8 is a block diagram illustrating a conventional fixed codebook search unit.

The fixed codebook search unit 111 is shown FIG. 8 in the form of a block diagram.

In FIG. 8, a correlation calculation unit 201 calculates a cross-correlation Q between a target vector x for the adaptive codebook search and an adaptive codebook vector Hp passed through a perceptual weighting synthesis filter (a cascade connection of a synthesis filter 106 and a perceptual weighting filter 109) according to equation (4), and the correlation calculation unit 201 outputs a calculation result to an evaluation formula numerator vector calculation unit 202.

$$Q = \frac{x^t Hp}{p^t H^t Hp} \tag{4}$$

Note that the target vector x for the adaptive codebook search is obtained by subtracting the zero input response of the perceptual weighting synthesis filter from the input speech signal passed though the perceptual weighting filter 109. The method of determining the target vector x for the adaptive codebook search is not limited to that described above, but other equivalent methods may be employed.

The evaluation formula numerator vector calculation unit 202 calculates the vector D in equation (3) using Q, x, and h, and outputs the calculated vector D to the evaluation formula numerator term calculation unit 203.

Note that h is an impulse response of the perceptual weighting synthesis filter, and the matrix H is a matrix (a lower triangular matrix) that convolutes h. In the calculations performed by the evaluation formula numerator vector calculation unit 202, the vector product matrix calculation unit 204, and the correlation matrix calculation unit 206, which will be described below, the multiplication of the matrix H can be performed as a convolution operation on the impulse response h.

The vector product matrix calculation unit 204 calculates a vector product matrix $H^tHpp^tH^tH$, which is the numerator of the second term in a matrix Φ in equation (3), and the vector product matrix calculation unit 204 outputs the calculated vector product matrix $H^tHpp^tH^tH$ to an evaluation formula denominator matrix calculation unit 205.

The correlation matrix calculation unit 206 calculates a correlation matrix $H^tH$, which is the first term in the matrix Φ in equation (3), and the correlation matrix calculation unit 206 outputs the calculated correlation matrix $H^tH$ to the evaluation formula denominator matrix calculation unit 205.

The evaluation formula denominator matrix calculation unit 205 calculates the matrix Φ in equation (3) using, in addition to the output from the vector product matrix calculation unit 204 and the output from the correlation matrix calculation unit 206, but also $p^tH^tHp$ calculated, in the determination of the cross-correlation Q, by the correlation calculation unit 201, and the evaluation formula denominator matrix calculation unit 205 outputs the calculated matrix Φ to an evaluation formula denominator term calculation unit 207.

The evaluation formula numerator term calculation unit 203 calculates the numerator term $N_{ort}$ in equation (3) for a fixed codebook vector $c_i$ specified by a fixed codebook vector index i, and the evaluation formula numerator term calculation unit 203 outputs the calculated numerator term $N_{ort}$ to an evaluation formula maximization unit 208.

The evaluation formula denominator term calculation unit 207 calculates the denominator term $D_{ort}$ in equation (3) for the fixed codebook vector $c_i$ specified by the fixed codebook vector index i, and the evaluation formula denominator term calculation unit 207 outputs the calculated denominator term $D_{ort}$ to the evaluation formula maximization unit 208.

The evaluation formula maximization unit 208 selects $c_i$ that maximizes $E_{ort}$ in equation (3), and outputs the selected $c_i$ as an optimum fixed codebook vector c (together with an index i thereof).

Figure 9:
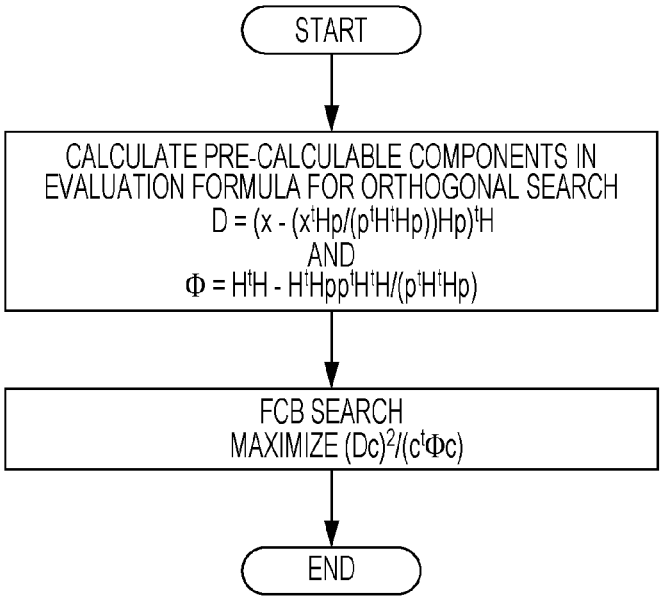
FIG. 9 is a flow chart illustrating a conventional fixed codebook search process.

FIG. 9 is a flow chart illustrating the process described above in terms of the conventional fixed codebook search.

Note that in the non-orthogonal search, the adaptive codebook vector and the adaptive codebook gain are fixed in the fixed codebook search, and thus the evaluation formula in terms of the coding distortion in the fixed codebook search is given by equation (5) described below.

$$E_{N\text{-}ort} = \frac{N_{N\text{-}ort}}{D_{N\text{-}ort}} = \frac{|(x - g_p Hp)^t Hc|^2}{c^t H^t Hc} \tag{5}$$

$g_p$: adaptive codebook gain determined in adaptive codebook search

In general, an upper limit (for example, 1.2 according to ITU-T recommendation G.729) and a lower limit (usually, 0) are set for the adaptive codebook gain. However, an ideal value of the adaptive codebook gain is not necessarily within this range. In the orthogonal search, an optimum value is selected taking into account only the "component orthogonal to the adaptive codebook vector" of the fixed codebook vector. This scheme is employed because it is possible to cancel out a "component that is not orthogonal to the adaptive codebook vector (that is, the same component of the adaptive codebook vector)" by adjusting the gain of the adaptive codebook vector. However, in a case where the ideal value of the adaptive codebook gain is outside the above-described range, the "adjustment" is impossible. Therefore, in the case where the ideal value of the adaptive codebook gain is outside the above-described range, the orthogonal search is not suitable.

In Japanese Unexamined Patent Application Publication No. 10-312198, switching between the orthogonal search and the non-orthogonal search is performed such that when the ideal value of the adaptive codebook gain is greater than a threshold value, the orthogonal search is performed. Therefore, in a case where an abrupt increase in signal energy occurs, for example, at an onset of a speech signal, the adaptive codebook gain is determined as being higher than the threshold value and the orthogonal search is employed. However, in many such cases, the shape of the adaptive codebook vector is not equal to the shape of the target vector for the adaptive codebook search, which results in a reduction in contribution of the adaptive codebook vector. In this situation, the target vector for the adaptive codebook search and the adaptive codebook vector are nearly orthogonal to each other, and thus it is meaningless to perform orthogonalization with respect to the adaptive codebook vector. In such a case, it is better not to employ the orthogonal search.

On the other hand, even in a case where the shape of the adaptive codebook vector is equal, the adaptive codebook gain is small for a part in which the signal energy is low, and thus the adaptive codebook gain is determined as being lower than the threshold value, and the orthogonal search is not employed. However, in such a case, the contribution of the adaptive codebook vector becomes high, and thus the orthogonal search may provide a better result.

First Embodiment

Figure 7:
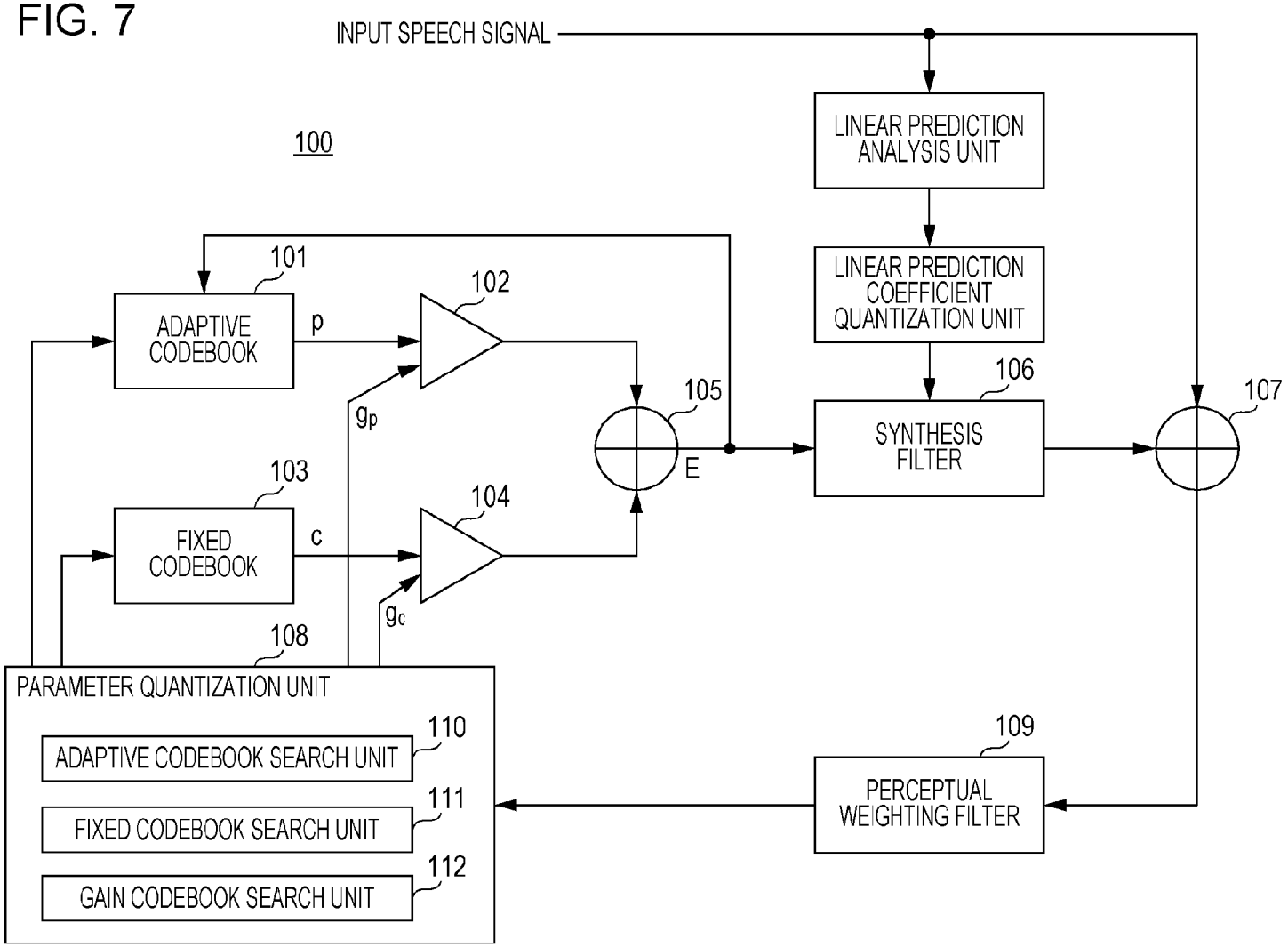
FIG. 7 is a block diagram illustrating a conventional CELP-type speech coding apparatus.

An embodiment of the present disclosure is described below with reference to drawings. The overall configuration of the speech coding apparatus according to the present disclosure is described below referring, as required, to FIG. 7. In FIG. 1, elements with the same names as those of the conventional speech coding apparatus shown in FIG. 8 are referred to by the same symbols as shown in FIG. 8.

FIG. 1 is a block diagram illustrating a fixed codebook search apparatus 300. The fixed codebook search apparatus 300 corresponds to the fixed codebook search unit 111 included in the parameter quantization unit 108 in FIG. 7.

In FIG. 1, a target vector for fixed codebook search calculation unit 309 calculates a target vector $x_2$ for the fixed codebook search by removing the adaptive codebook component determined by the adaptive codebook search from the target vector x for the adaptive codebook search as described below, and $x_2$ is used instead of x in the conventional method.

$$x_2 = x - g_p Hp \tag{6}$$

$x_2$: target vector for the fixed codebook search $g_p$: adaptive codebook gain determined when adaptive codebook search is performed Note that the adaptive codebook gain $g_p$ is given by a following equation, in which $g_{pMin}$ is a lower limit of the adaptive codebook gain, and $g_{pMax}$ is an upper limit of the adaptive codebook gain.

$$g_p = \begin{cases} g_{p_Max}, \text{ if } g_{p_Max} < g_p \\ \dfrac{x^t Hp}{p^t H^t Hp}, \text{ if } g_{p_Min} \le g_p \le g_{p_Max} \\ g_{p_Min}, \text{ if } g_p < g_{p_Min} \end{cases} \tag{7}$$

If the following equation (8)

$$x = x_2 + g_p Hp \tag{8}$$

obtained by rewriting equation (6) and $g_p$ represented by equation (7) are substituted in the numerator term in equation (2), that is, in the vector D in equation (3), then the term $g_p$Hp is cancelled out. As a result, the following expression is obtained.

$$D = \left(x_2 - \frac{(x_2^t Hp)Hp}{p^t H^t Hp}\right)^t H \tag{9}$$

Thus, in equation (1) and equation (2), when the target vector x for the adaptive codebook search in the adaptive codebook search is replaced by the target vector $x_2$ for the fixed codebook search, the resultant equations are equivalent to the original equations.

A correlation calculation unit 301 determines a cross-correlation $Q_2$ from $x_2$ and Hp according to equation (10). The cross-correlation $Q_2$ is a measure indicating orthogonality between the target vector $x_2$ and the adaptive codebook vector Hp. When the cross-correlation $Q_2$ is small, the orthogonality is high, while when the cross-correlation $Q_2$ is large, the orthogonality is low.

$$Q_2 = \frac{x_2^t Hp}{p^t H^t Hp} \tag{10}$$

Note that although the cross-correlation $Q_2$ is used to express the correlation value in the present embodiment, another value may be used to express the correlation value if the value includes at least the inner product of the target vector for the fixed codebook search and the adaptive codebook vector obtained as a result of the synthesis filtering process (the inner product corresponds to the numerator of the cross-correlation $Q_2$).

Alternatively, it is allowed to use a normalized cross-correlation expressed by equation (11).

$$Q_2 = \frac{x_2^t Hp}{\sqrt{x_2^t x_2}\sqrt{p^t H^t Hp}} \tag{11}$$

Thereafter, an orthogonal/non-orthogonal determination unit 310 selects the orthogonal search or the non-orthogonal search depending on the value of the cross-correlation $Q_2$ input from the correlation calculation unit 301, and the orthogonal/non-orthogonal determination unit 310 outputs a determination result, that is, the information indicating the selected search mode, to an evaluation formula numerator vector calculation unit 302 and a vector product matrix calculation unit 304.

In a case where the orthogonal search is selected, the evaluation formula numerator vector calculation unit 302 calculates an evaluation formula numerator vector D using $x_2$, $Q_2$, and h. On the other hand, in a case where the non-orthogonal search is selected, the evaluation formula numerator vector calculation unit 302 calculates the evaluation formula numerator vector D by regarding $Q_2$ input from the correlation calculation unit 301 as being zero.

In the case where the orthogonal search is selected, the vector product matrix calculation unit 304 calculates a vector product matrix $H^t Hpp^t H^t H$. On the other hand, in the case where the non-orthogonal search is selected, the vector product matrix calculation unit 304 outputs a zero matrix as the vector product matrix.

Thereafter, the same process as that shown in FIG. 8 is performed.

Figure 2:
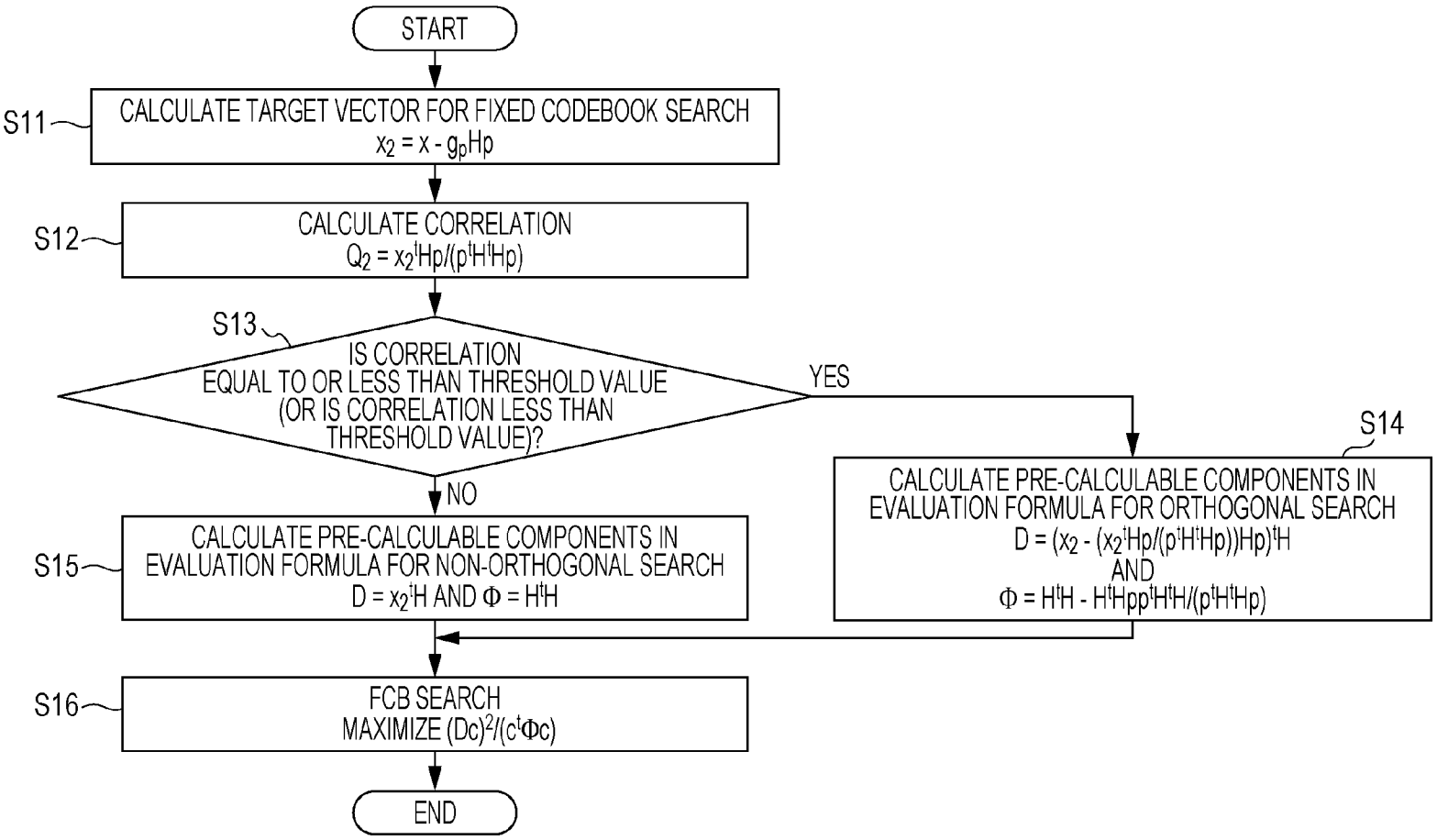
FIG. 2 is a flow chart illustrating a fixed codebook search process according to the first embodiment of the present disclosure.

FIG. 2 is a flow chart illustrating a fixed codebook search process performed by the fixed codebook search apparatus 300 according to the first embodiment of the present disclosure.

First, the fixed codebook search apparatus 300 calculates the target vector $x_2$ for the fixed codebook search (S11). Next, the fixed codebook search apparatus 300 calculates the cross-correlation $Q_2$ between $x_2$ and the adaptive codebook vector Hp (S12). The fixed codebook search apparatus 300 then determines whether the calculated cross-correlation $Q_2$ is equal to or smaller than a predetermined threshold value (or whether the cross-correlation $Q_2$ is smaller than the threshold value) (S13). In a case where the calculated cross-correlation $Q_2$ is equal to or smaller than the threshold value (or the calculated cross-correlation $Q_2$ is smaller than the threshold value), the fixed codebook search apparatus 300 calculates a pre-calculable component in an error evaluation function for orthogonal search (S14). In a case where the calculated cross-correlation $Q_2$ is greater than the threshold value (or the calculated cross-correlation $Q_2$ is equal to or greater than the threshold value), the fixed codebook search apparatus 300 calculates a pre-calculable component in an error evaluation function for non-orthogonal search (S15). Finally, the fixed codebook search apparatus 300 calculates the error evaluation function using D and Φ for all vectors c, and selects a fixed codebook vector c that maximizes the evaluation function (S16).

Note that the threshold value for the cross-correlation $Q_2$ may be set to an optimum value determined experimentally. When the determined adaptive codebook gain is within a range from the lower limit to the upper limit of the adaptive codebook gain, the normalized correlation $Q_2$ is zero. Therefore, it is desirable that the threshold value is set to a value close to 0, for example, 0.0001 or the like.

In the present embodiment, as described above, the orthogonal search or the non-orthogonal search is selected based on the correlation value of the target vector for the fixed codebook search minus the provisionally determined adaptive codebook component with respect to the adaptive codebook vector. Therefore, it is possible to selectively use the non-orthogonal search when there is low orthogonality between the target vector in the fixed codebook search and the adaptive codebook vector. Thus it is possible to provide a method of properly selecting the orthogonal search or the non-orthogonal search in the fixed codebook search.

Note that in the calculation of the target vector $x_2$ for the fixed codebook search, when $g_p$ is represented by equation (7), that is, when $g_p$ has an ideal value of the adaptive codebook gain, the cross-correlation value $Q_2$ is calculated as zero by the correlation calculation unit 301. Therefore, the adaptive codebook gain $g_p$ does not have an ideal value when the calculated ideal adaptive codebook gain $g_p$ does not fall in the preset range from the lower limit to the upper limit of the adaptive codebook gain. The cross-correlation value $Q_2$ increases (decreases in the case where the cross-correlation value $Q_2$ is negative) depending on the degree of exceedance beyond upper limit or the lower limit.

Using the feature described above, the orthogonal search or the non-orthogonal search of the fixed codebook may be selected depending on whether the value of $g_p$ used in calculation of the target vector $x_2$ for the fixed codebook search is ideal or out of the range from the lower limit to the upper limit thereby achieving advantageous effects similar to those described above.

It is allowed to switch between fixed codebooks depending on whether the orthogonal search is used or not. It is also allowed to switch between dispersion vectors in a case where pulse dispersion is performed. In this case, if switching information is transmitted to a decoding apparatus, it becomes possible for the decoding apparatus to generate a synthesized speech signal similar to that generated by a coding apparatus.

Second Embodiment

Figure 3:
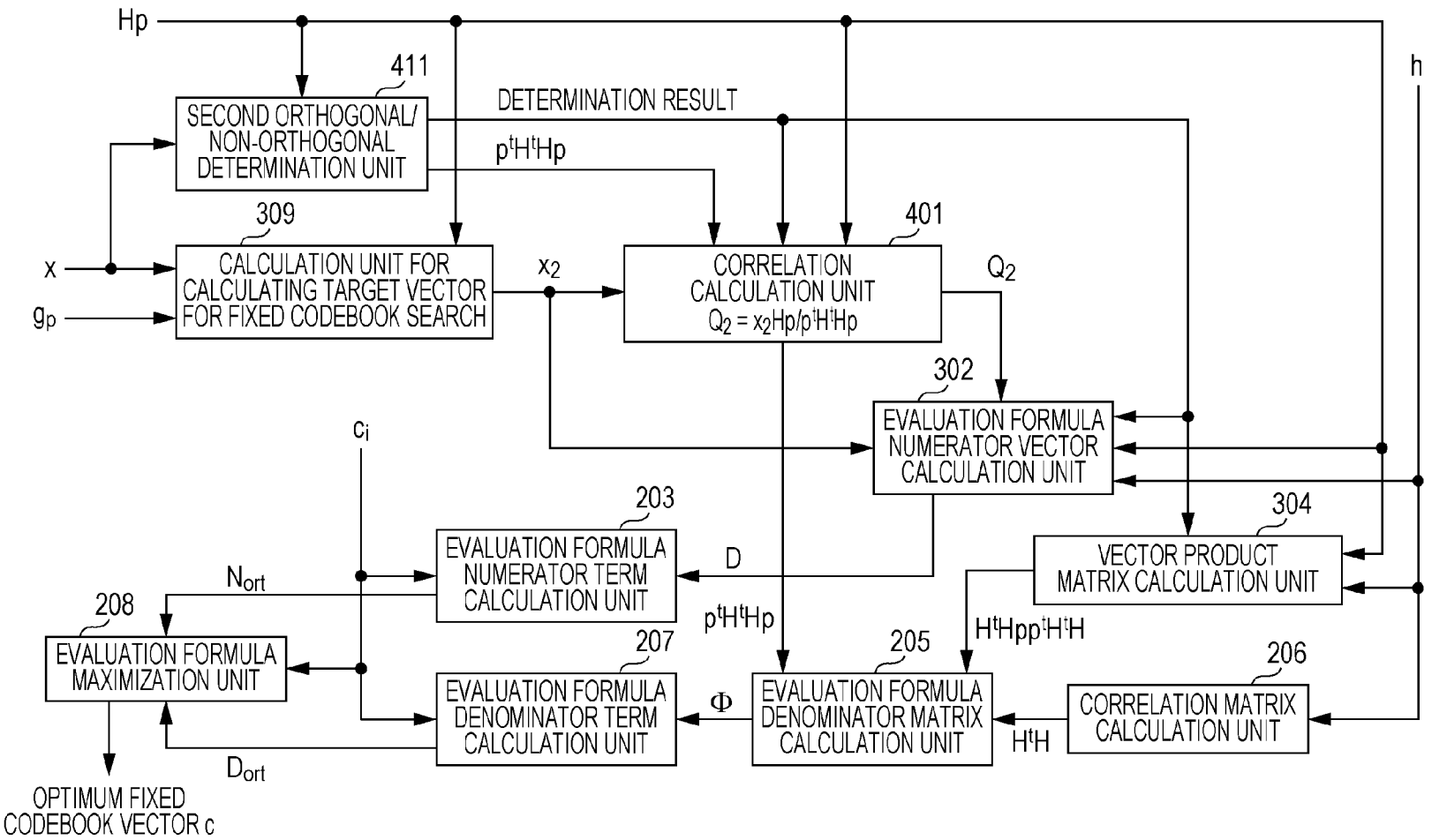
FIG. 3 is a block diagram illustrating a fixed codebook search unit according to a second embodiment of the present disclosure.

FIG. 3 is a block diagram illustrating a fixed codebook search apparatus 400 according to a second embodiment of the present disclosure. In FIG. 3, constituent elements similar to those in FIG. 1 or FIG. 8 are denoted by similar reference symbols, and a description thereof is omitted.

In FIG. 3, a second orthogonal/non-orthogonal determination unit 411 receives a target vector x for the adaptive codebook search and an adaptive codebook vector Hp obtained as a result of the synthesis filtering process. The second orthogonal/non-orthogonal determination unit 411 calculates a distance d between a vector V1 and a vector V2 according to equation (12) shown below where the vector V1 is given by diagonal elements of a vector product matrix normalized by the inner product between x and Hp, while the vector V2 is given by diagonal elements of a vector product matrix of an adaptive codebook vector normalized by energy.

$$V1 = \frac{xp^t H^t(i, i)}{x^t Hp} \qquad (12)$$

$$V2 = \frac{Hpp^t H^t(i, i)}{|Hp|^2}$$

$$d = |V1 - V2|^2$$

$xp^tH^t$ (i, i): diagonal elements of a square matrix $xp^tH^t$ $Hpp^tH^t$ (i, i): diagonal elements of a square matrix $Hpp^tH^t$ In the example described above, the distance d is expressed by the distance between two vectors given by diagonal elements. Alternatively, other formulas may be employed. For example, the difference between two matrices is determined, and the distance may be given by a determinant calculated therefrom.

In a case where the calculated value of d is greater than a threshold value (for example, 0.1 to 0.3), the second orthogonal/non-orthogonal determination unit 411 determines that the orthogonal search is not performed but the non-orthogonal search is performed. The second orthogonal/non-orthogonal determination unit 411 outputs a determination result to a correlation calculation unit 401, an evaluation formula numerator vector calculation unit 302, and a vector product matrix calculation unit 304. Furthermore, the second orthogonal/non-orthogonal determination unit 411 outputs $p^tH^tHp$ obtained via the process of calculating equation (12) to the correlation calculation unit 401. $p^tH^tHp$ is used by the correlation calculation unit 401 in determining the cross-correlation $Q_2$.

Note that the threshold value for d may also be set to an optimum value experimentally determined. Experiments performed by the present inventors turn out that it is preferable to set the threshold value to a value in a range from 0.1 to 0.3, and more preferably to a value close to 0.125.

The correlation calculation unit 401 outputs $p^tH^tHp$ directly to an evaluation formula denominator matrix calculation unit 205. Furthermore, in a case where the result of the determination by the second orthogonal/non-orthogonal determination unit 411 indicates that orthogonal search is to be used, the correlation calculation unit 401 determines the cross-correlation $Q_2$ and outputs it to the evaluation formula numerator vector calculation unit 302. On the other hand, in a case where the result of the determination by the second orthogonal/non-orthogonal determination unit 411 indicates that non-orthogonal search is to be used, the correlation calculation unit 401 does not perform any processing because it is not necessary to determine the cross-correlation $Q_2$. Alternatively, as a matter of course, the correlation calculation unit 401 may determine the cross-correlation $Q_2$ regardless of the result of the determination and may output it to the evaluation formula numerator vector calculation unit 302, and the evaluation formula numerator vector calculation unit 302 may replace the cross-correlation $Q_2$ with zero, as in the first embodiment.

Figure 4:
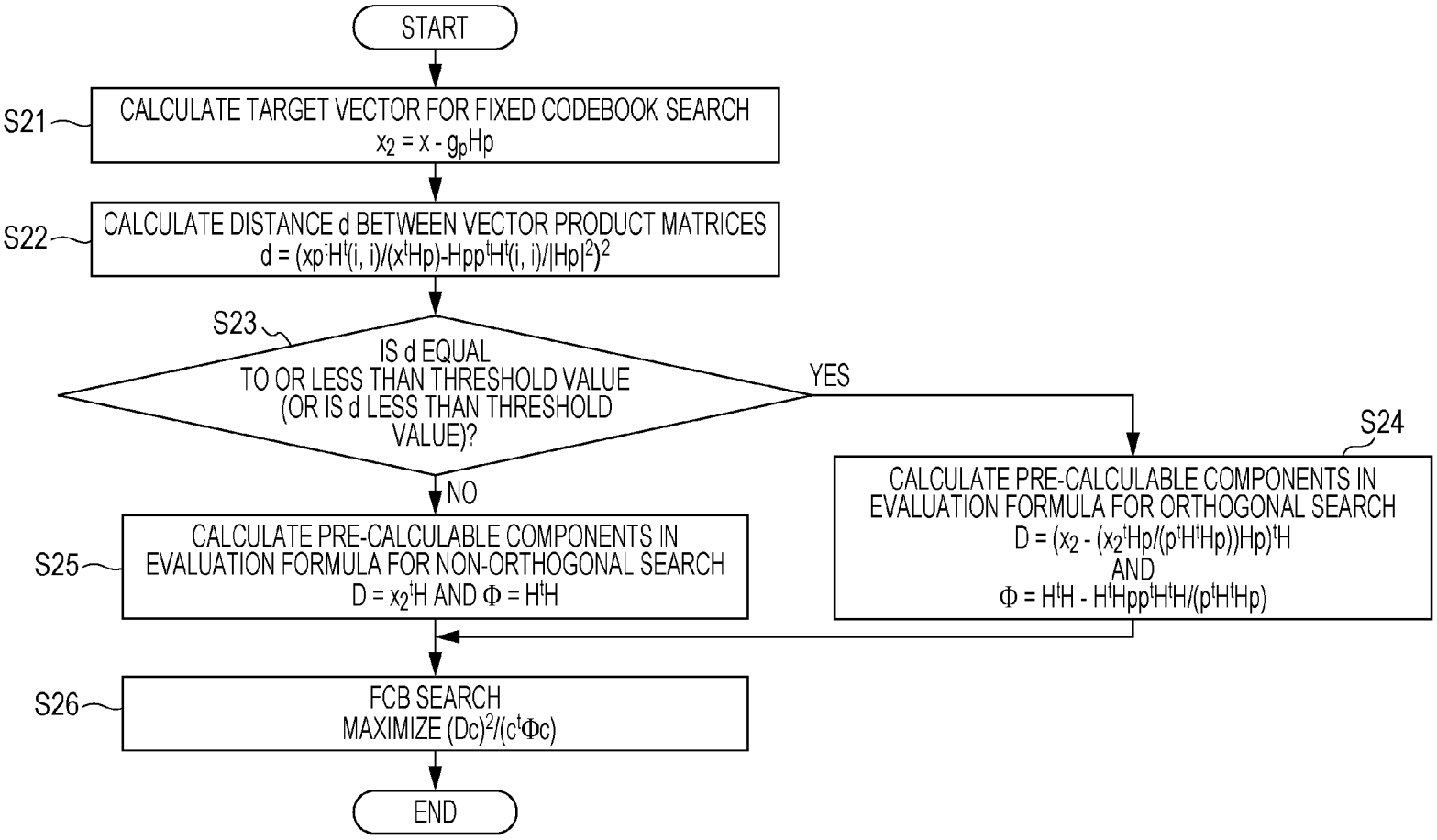
FIG. 4 is a flow chart illustrating a fixed codebook search process according to the second embodiment of the present disclosure.

FIG. 4 is a flow chart illustrating a fixed codebook search process performed by the fixed codebook search apparatus 400 according to the second embodiment of the present disclosure. First, the fixed codebook search apparatus 400 calculates the target vector $x_2$ for the fixed codebook search (S21). Next, the fixed codebook search apparatus 400 calculates the distance d (S22). The fixed codebook search apparatus 400 then determines whether d is equal to or smaller than a threshold value (or whether d is smaller than the threshold value) (S23). In a case where d is equal to or smaller than the threshold value (or d is smaller than the threshold value), the fixed codebook search apparatus 400 calculates a pre-calculable component in an error evaluation function for orthogonal search (S24). On the other hand, in a case where d is greater than the threshold value (or d is equal to or greater than the threshold value), the fixed codebook search apparatus 400 calculates a pre-calculable component in an error evaluation function for non-orthogonal search (S25). Finally, the fixed codebook search apparatus 400 calculates the error evaluation function using D and Φ for all vectors c, and selects a fixed codebook vector c that allows the evaluation function to have a maximum value (S26).

Now, a principle is described below as to the orthogonal/non-orthogonal determination based on the distance d.

In the orthogonal search, the adaptive codebook gain $g_p$ is represented by the following equation.

$$g_p = \frac{x^t Hp}{p^t H^t Hp} \times \frac{c^t H^t Hc - U1}{c^t H^t Hc - U2} \tag{13}$$

$$U1 = \frac{(x^t Hc)(p^t H^t Hc)}{x^t Hp}$$

$$U2 = \frac{c^t H^t Hpp^t H^t Hc}{p^t H^t Hp}$$

The ideal adaptive codebook gain $g_p$ obtained in the adaptive codebook search is given by equation (7) (when $g_p$ is in the range from the lower limit and the upper limit), and thus if U1 and U2 in equation (13) are close to each other, then the second term in equation (13) becomes close to 1. Thus, the adaptive codebook gain in the orthogonal search of the fixed codebook has a value close to the adaptive codebook gain in the adaptive codebook search.

On the other hand, in a case where values of U1 and U2 are greatly different, the second term in equation (13) has a value greatly different from 1. Thus, although depending on the selected fixed codebook vector, the second term in equation (13) is likely to be greatly different from the ideal adaptive codebook gain $g_p$ of equation (7). U1 and U2 are respectively represented by equation (14).

$$U1 = \frac{c^t H^t (xp^t H^t) Hc}{x^t Hp} \tag{14}$$

$$U2 = \frac{c^t H^t (Hpp^t H^t) Hc}{p^t H^t Hp}$$

Note that U1 and U2 in equation (14) are obtained by multiplying vector product matrices represented by equation (15) by the fixed codebook vector Hc obtained as a result of the synthesis filtering process from left and right sides.

$$U1' = \frac{xp^t H^t}{x^t Hp} \tag{15}$$

$$U2' = \frac{Hpp^t H^t}{p^t H^t Hp}$$

Therefore, as the distance between these two vector product matrices U1' and U2' increases, the probability increases that the values of U1 and U2 are greatly different.

In both U1' and U2', diagonal components are greatest of all components, that is, diagonal components are dominant elements. Therefore, as shown in equation (12), the Euclidean distance between V1 and V2 which are respectively given by diagonal components of U1' and U2' is employed as the measure.

Note that $g_p$ represented by equation (7) is the adaptive codebook gain for the case in which the non-orthogonal search is performed and $g_p$ represented by equation (13) is the adaptive codebook gain for the case in which the orthogonal search is performed, and therefore increasing in the difference between these two gains means that the fixed codebook vector includes many components which are the same as those in the adaptive codebook vector. In this case, cancelling out (or distributing) occurs in many components between the fixed codebook vector and the adaptive codebook vector. Therefore, if cancelling out (or distribution) is not properly performed, effects of the orthogonalization are not achieved. This can occur with a high probability, as can be seen from equation (13), when there is a large difference between matrices U1' and U2'.

In a case where an increase is allowed in terms of the amount of calculation in the fixed codebook search, the fixed codebook search apparatus 400 may calculate equation (13) in a sequential manner in the fixed codebook search and may make the determination based on whether the obtained adaptive codebook gain is within the range of the quantization adaptive codebook gain.

Now, technical significances of the distance d are described below. Hereinafter, for simplicity, the adaptive codebook synthesis vector Hp will be denoted by y.

Equation (12) can be rewritten using the target vector x and the adaptive codebook synthesis vector y as follows.

$$d = |V1 - V2|^2 = \sum_i \left( \frac{x(i)y(i)}{\sum_j x(j)y(j)} - \frac{y(i)y(i)}{\sum_j y(j)y(j)} \right)^2 \tag{16}$$

Herein, if the target vector x is represented by a vector sum of a vector including components having a correlation with the adaptive codebook synthesis vector y (that is represented in the form of y times a) and a vector z including a non-correlation components, then the result is given by equation (17).

$$x = ay + z$$

$$xz = 0 \tag{17}$$

Using this equation (16) can be rewritten as follows.

$$\begin{aligned} d &= \sum_i \left( \frac{x(i)y(i)}{\sum_j x(j)y(j)} - \frac{y(i)y(i)}{\sum_j y(j)y(j)} \right)^2 \\ &= \sum_i \left( \frac{ay(i)y(i) + z(i)y(i)}{\sum_j \{ay(j)y(j) + z(j)y(j)\}} - \frac{y(i)y(i)}{\sum_j y(j)y(j)} \right)^2 \\ &= \sum_i \left( \frac{ay(i)y(i) + z(i)y(i)}{a\sum_j y(j)y(j) + \sum_j z(j)y(j)} - \frac{y(i)y(i)}{\sum_j y(j)y(j)} \right)^2 \\ &= \sum_i \left( \frac{ay(i) + z(i)y(i)}{a\sum_j y(j)y(j)} - \frac{y(i)y(i)}{\sum_j y(j)y(j)} \right)^2 \end{aligned} \tag{18}$$

-continued $$= \sum_i \left( \frac{y(i)y(i)}{\sum_j y(j)y(j)} + \frac{z(i)y(i)}{a\sum_j y(j)y(j)} - \frac{y(i)y(i)}{\sum_j y(j)y(j)} \right)^2$$

$$= \sum_i \left( \frac{z(i)y(i)}{a\sum_j y(j)y(j)} \right)^2$$

Thus it can be seen that d is equal to the ratio of the power of the non-correlation components to the power of the correlation components between x and y.

That is, the greater the non-correlation components between x and y (and the smaller the correlation components), the greater the value of D. Conversely, the smaller the non-correlation components between x and y (and the greater the correlation components), the smaller the value of d, and d approaches 0.

From the above discussion, it can be seen that the distance d is a parameter indicating the degree of similarity of the shape of the adaptive codebook synthesis vector y to the shape of the target vector x.

In the present embodiment, as described above, it is possible to determine whether or not there is a high probability that the adaptive codebook gain determined after the orthogonal search of the fixed codebook is greatly different from the adaptive codebook gain obtained in the adaptive codebook search. It is possible to properly select the orthogonal search or the non-orthogonal search in the fixed codebook search.

Modifications to Second Embodiment

Figure 5:
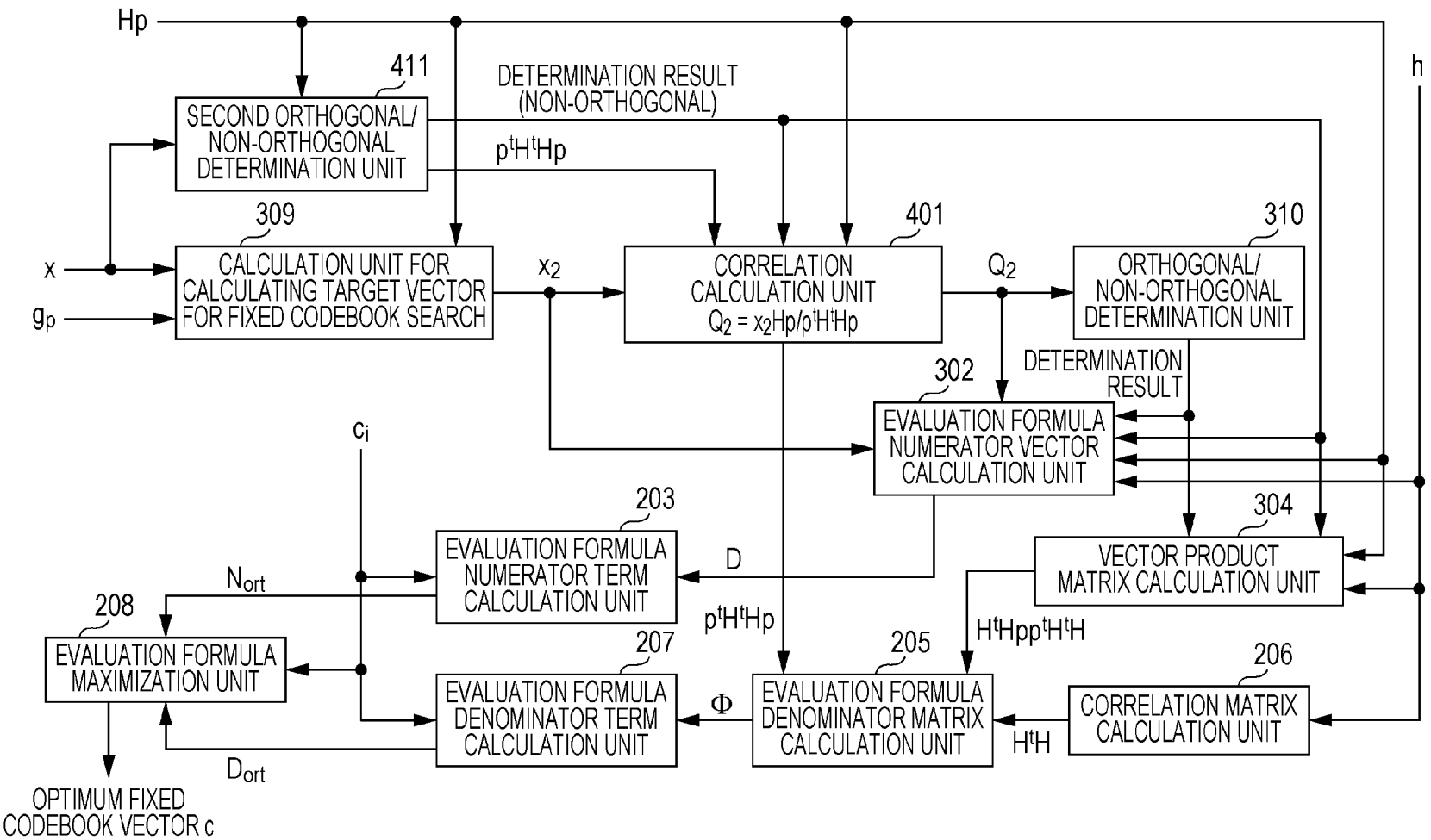
FIG. 5 is a block diagram illustrating an example of a fixed codebook search unit according to a modification to the second embodiment of the present disclosure.

FIG. 5 is a block diagram illustrating an example of a fixed codebook search apparatus 500 according to a modification to the second embodiment. In this modification, the orthogonal/non-orthogonal determination is performed via a two-stage process. A second orthogonal/non-orthogonal determination unit 411 which is a characteristic part in the fixed codebook search apparatus 400 according to the second embodiment is disposed at a first stage, and an orthogonal/non-orthogonal determination unit 310 which is a characteristic part in the fixed codebook search apparatus 300 according to the first embodiment is disposed at a second stage.

The present modification is different from the second embodiment as follows. In the second embodiment, the correlation calculation unit 401 outputs the result of the determination by the second orthogonal/non-orthogonal determination unit 411 directly to the evaluation formula numerator vector calculation unit 302 and the vector product matrix calculation unit 304. In contrast, in the present modification, as in the first embodiment, the correlation calculation unit 401 outputs a cross-correlation $Q_2$ to the orthogonal/non-orthogonal determination unit 310, and the orthogonal/non-orthogonal determination unit 310 outputs a determination result to the evaluation formula numerator vector calculation unit 302 and the vector product matrix calculation unit 304.

In FIG. 5, in a case where the second orthogonal/non-orthogonal determination unit 411 determines that the non-orthogonal search is to be used, the second orthogonal/non-orthogonal determination unit 411 outputs the determination result to the correlation calculation unit 401, the evaluation formula numerator vector calculation unit 302, and the vector product matrix calculation unit 304. On the other hand, in a case where the second orthogonal/non-orthogonal determination unit 411 determines that the orthogonal search is to be used, the vector product matrix calculation unit 304 does not output the determination result.

The process performed by the correlation calculation unit 401 is similar to that according to the first embodiment. The evaluation formula numerator vector calculation unit 302 and the vector product matrix calculation unit 304 perform processing in similar manners to the first and second embodiments based on the determination results of the second orthogonal/non-orthogonal determination unit 411 and the orthogonal/non-orthogonal determination unit 310.

Figure 6:
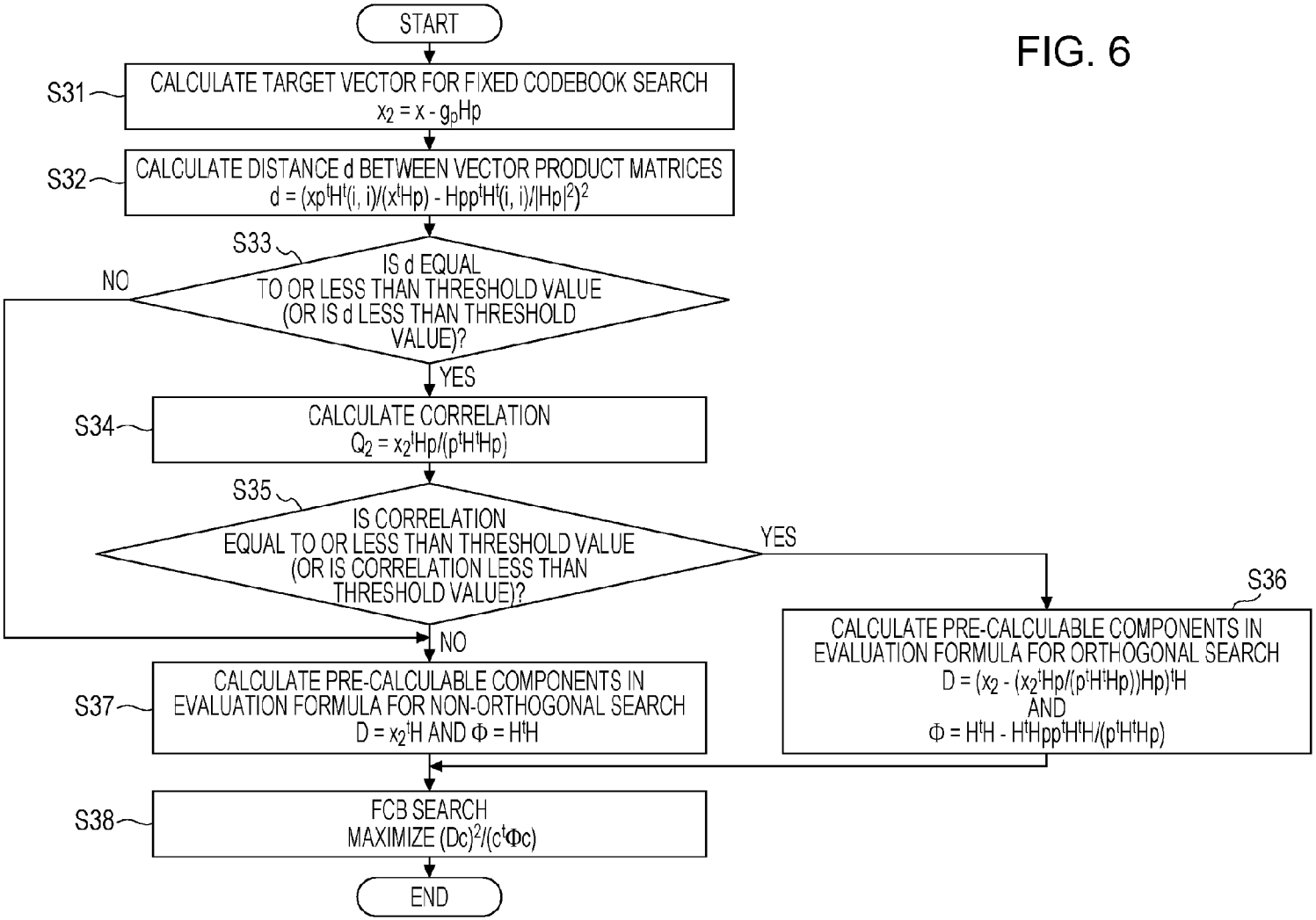
FIG. 6 is a flow chart illustrating an example of a fixed codebook search process according to the modification to the second embodiment of the present disclosure.

FIG. 6 is a flow chart illustrating a fixed codebook search process performed by the fixed codebook search apparatus 500 according to the present embodiment. First, the fixed codebook search apparatus 500 calculates the target vector $x_2$ for the fixed codebook search (S31). Next, the fixed codebook search apparatus 500 calculates the distance d (S32). The fixed codebook search apparatus 500 then determines whether d is equal to or smaller than a threshold value (or whether d is smaller than the threshold value) (S33). In a case where d is equal to or smaller than the threshold value (or d is smaller than the threshold value), the fixed codebook search apparatus 500 advances the processing flow to the normalized correlation calculation as in the first embodiment (S34) and determines whether the calculated normalized correlation $Q_2$ is equal to or smaller than the predetermined threshold value (or whether the normalized correlation $Q_2$ is smaller than the threshold value) (S35). In a case where the normalized correlation $Q_2$ is equal to or smaller than the threshold value (or the normalized correlation $Q_2$ is smaller than the threshold value), the fixed codebook search apparatus 500 calculates a pre-calculable component in an error evaluation function for orthogonal search (S36). In a case where the normalized correlation $Q_2$ is greater than the threshold value (or the normalized correlation $Q_2$ is equal to or greater than the threshold value), the fixed codebook search apparatus 500 calculates a pre-calculable component in an error evaluation function for non-orthogonal search (S37). In a case where d is greater than a threshold value (or d is equal to or greater than the threshold value), the fixed codebook search apparatus 500 calculates a pre-calculable component in an error evaluation function for non-orthogonal search (S37). Finally, the fixed codebook search apparatus 500 calculates the error evaluation function using D and Φ for all vectors c, and selects a fixed codebook vector c that maximizes the evaluation function (S38).

In the present embodiment, as described above, two criteria respectively according to the first and second embodiments are used to make it possible to more properly select the orthogonal search or the non-orthogonal search in the fixed codebook search.

The flows shown in FIG. 2, FIG. 4, and FIG. 6 represent operations of dedicatedly designed hardware. These flows may also be realized by installing, in general-purpose hardware, a program that executes a speech coding method including a fixed codebook search method represented by the flows. Examples usable as the general-purpose computer include a personal computer, various kinds of portable information terminals such as a smartphone, a portable telephone, etc.

The dedicatedly designed hardware is not limited to a so-called finished product (of consumer electronics) such as a portable telephone, a fixed-line telephone, or the like, but it should be understood that the dedicatedly designed hardware may include a semifinished product or a part such as a system board, a semiconductor device, and the like.

The speech coding apparatus according to the present disclosure is useful as a speech codec processing chip or the like including a fixed codebook search unit capable of switching between the orthogonal search and the non-orthogonal search installed in a portable terminal or a voice gateway. The speech coding apparatus according to the present disclosure may also be used in applications such as an IC recording apparatus, VoIP (Voice over IP), and the like.

What is claimed is:

1. A Code-Excited Linear Prediction (CELP) type speech coding apparatus, comprising:

a receiver that receives an input speech signal for encoding;

an adaptive codebook that outputs an adaptive codebook vector representing a periodic component;

a fixed codebook that outputs a fixed codebook vector representing a non-periodic component;

an adder that generates an excitation signal from the adaptive codebook vector and the fixed codebook vector;

a synthesis filter that operates based on a linear prediction coefficient obtained by performing linear prediction analysis on the input speech signal and quantization and that is driven by the excitation signal thereby generating a synthesized speech signal; and a parameter quantizer that selects the adaptive codebook vector and the fixed codebook vector so as to minimize an error between the synthesized speech signal and the input speech signal, wherein the parameter quantizer includes a fixed codebook searcher that switches between an orthogonal fixed codebook search and a non-orthogonal fixed codebook search based on a correlation value between a target vector for the fixed codebook search and the adaptive codebook vector obtained as a result of the process by the synthesis filter, and outputs switching information whether the orthogonal search is used or not, for transmitting the switching information over a communication channel to a decoder.

2. The CELP type speech coding apparatus according to claim 1, wherein the fixed codebook searcher further switches between the orthogonal fixed codebook search and the non-orthogonal fixed codebook search based on a distance between a vector product matrix of a target vector for the adaptive codebook search and the adaptive codebook vector obtained as a result of the synthesis filtering process and a vector product matrix of the adaptive codebook vector obtained as the result of the synthesis filtering process.

3. A Code-Excited Linear Prediction (CELP) type speech coding method, comprising:

receiving an input speech signal for encoding;

outputting an adaptive codebook vector representing a periodic component;

outputting a fixed codebook vector representing a non-periodic component;

generating an excitation signal from the adaptive codebook vector and the fixed codebook vector;

generating a synthesized speech signal by driving, with the excitation signal, a synthesis filter using a linear prediction coefficient obtained by performing linear prediction analysis on the input speech signal and quantization; and selecting the adaptive codebook vector and the fixed codebook vector so as to minimize an error between the synthesized speech signal and the input speech signal, wherein the selecting of the fixed codebook is performed by switching between an orthogonal fixed codebook search and a non-orthogonal fixed codebook search based on a correlation value between a target vector for the fixed codebook search and the adaptive codebook vector obtained as a result of the process by the synthesis filtering process, and wherein switching information is output whether the orthogonal search is used or not, the switching information being transmitted over a communication channel to a decoder.

4. A Code-Excited Linear Prediction (CELP) type speech coding apparatus, comprising:

a receiver that receives an input speech signal for encoding;

an adaptive codebook that outputs an adaptive codebook vector representing a periodic component;

a fixed codebook that outputs a fixed codebook vector representing a non-periodic component;

an adder that generates an excitation signal from the adaptive codebook vector and the fixed codebook vector;

a synthesis filter that operates based on a linear prediction coefficient obtained by performing linear prediction analysis on the input speech signal and quantization and that is driven by the excitation signal thereby generating a synthesized speech signal; and a parameter quantizer that selects the adaptive codebook vector and the fixed codebook vector so as to minimize an error between the synthesized speech signal and the input speech signal, wherein the parameter quantizer includes a fixed codebook searcher that switches between an orthogonal fixed codebook search and a non-orthogonal fixed codebook search based on a distance between a vector product matrix of a target vector for the adaptive codebook search and the adaptive codebook vector obtained as a result of the synthesis filtering process and a vector product matrix of the adaptive codebook vector obtained as the result of the synthesis filtering process filter, and outputs switching information whether the orthogonal search is used or not, for transmitting the switching information over a communication channel to a decoder.

5. A Code-Excited Linear Prediction (CELP) type speech coding method, comprising:

receiving an input speech signal for encoding;

outputting an adaptive codebook vector representing a periodic component;

outputting a fixed codebook vector representing a non-periodic component;

generating an excitation signal from the adaptive codebook vector and the fixed codebook vector;

generating a synthesized speech signal by driving, with the excitation signal, a synthesis filter using a linear prediction coefficient obtained by performing linear prediction analysis on the input speech signal and quantization; and selecting the adaptive codebook vector and the fixed codebook vector so as to minimize an error between the synthesized speech signal and the input speech signal, wherein the selecting of the fixed codebook is performed by switching between an orthogonal fixed codebook search and a non-orthogonal fixed codebook search based on a distance between a vector product matrix of a target vector for the adaptive codebook search and an adaptive codebook vector obtained as a result of the synthesis filtering process and a vector product matrix of the adaptive codebook vector obtained as the result of the synthesis filtering process, and wherein switching information is output whether the orthogonal search is used or not, the switching information being transmitted over a communication channel to a decoder.

* * * * *